US008000620B2

(12) United States Patent
Kim et al.

(10) Patent No.: US 8,000,620 B2
(45) Date of Patent: Aug. 16, 2011

(54) IMAGE FORMING APPARATUS AND TRANSFER METHOD THEREOF

(75) Inventors: Jeong-hwan Kim, Gunsan-si (KR); Jin-cheol Kim, Suwon-si (KR); Hyun-sun Jung, Seongnam-si (KR); Yoo-seok Yang, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 709 days.

(21) Appl. No.: 11/962,634

(22) Filed: Dec. 21, 2007

(65) Prior Publication Data

US 2008/0166146 A1 Jul. 10, 2008

(30) Foreign Application Priority Data

Jan. 8, 2007 (KR) ..... 10-2007-0002219

(51) Int. Cl.
*G03G 15/00* (2006.01)
*G03G 15/01* (2006.01)

(52) U.S. Cl. ..... 399/66; 399/38; 399/88; 399/299

(58) Field of Classification Search ..... 399/38, 399/66, 75, 88, 89, 297–299, 303
See application file for complete search history.

(56) References Cited

U.S. PATENT DOCUMENTS 5,887,220 A * 3/1999 Nagaoka ..... 399/46
6,111,594 A * 8/2000 Jeong ..... 347/140
6,148,159 A * 11/2000 Shiraishi ..... 399/44

FOREIGN PATENT DOCUMENTS

| | | |
|---|---|---|
| CN | 1207509 | 2/1999 |
| JP | 7-239617 | 9/1995 |
| JP | 9-305037 | 11/1997 |
| KR | 96-42250 | 12/1996 |
| KR | 1998-31958 | 7/1998 |

OTHER PUBLICATIONS

Chinese Office Action issued May 25, 2011 in CN Application No. 200810000933.5.

* cited by examiner

*Primary Examiner* — David P Porta
*Assistant Examiner* — Jessica L Eley
(74) *Attorney, Agent, or Firm* — Stanzione & Kim, LLP

(57) ABSTRACT

An image forming apparatus includes a moving unit including a conveyer belt which moves a printing medium, an attraction unit to attract the printing medium to the conveyer belt, a transferring unit to transfer developer onto the printing medium, a power supply which supplies transfer power and attraction power to the transferring unit and the attraction unit, and a controller which controls the power supply to supply only one of the transfer power and the attraction power in accordance with a location of the printing medium.

26 Claims, 10 Drawing Sheets

IMAGE FORMING APPARATUS AND TRANSFER METHOD THEREOF

CROSS-REFERENCE TO RELATED APPLICATIONS

This application claims benefit of priority under 35 U.S.C. §119(a) from Korean Patent Application No. 10-2007-0002219, filed on Jan. 8, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus that determines a transfer voltage or a transfer current, and a control method thereof.

2. Description of the Related Art

An image forming apparatus forms an image to be output on a recording medium, and the contents of the image are generated by a computer program. In further detail, the image forming apparatus forms an electrostatic latent image by scanning light onto a photosensitive body, the electrostatic latent image is developed by a developer, and then the developed image is transferred and fixed on paper so that an image is formed.

FIG. 1 illustrates a transferring process of a conventional image forming apparatus.

As illustrated in FIG. 1, the conventional image forming apparatus includes a transferring device 2 and an attraction unit 1, and the transferring device 2 includes a plurality of transferring units 2*a* to 2*d*. The transferring unit 2*a* that is disposed closest to the attraction unit 1 among the plurality of transferring units 2*a* to 2*d* is established as a reference transferring unit, and a resistance value of the transferring unit 2*a* is obtained by detecting a current flowing therein so that an optimal transfer voltage or transfer current can be determined during a pre-printing process that is performed before printing on a printing medium.

The resistance value of the transferring unit 2*a* is characterized by a current therein corresponding to a voltage applied across a photosensitive body, a conveyor belt that passes through the corresponding transferring unit 2*a*, and a transfer roller disposed opposite to the photosensitive body across the conveyer belt. Knowing this resistance allows optimizing the energy to transfer toner developed on the charged photosensitive body to the printing medium.

Once the resistance value of the transferring unit 2*a* is determined, the conventional image forming apparatus ascertains a resistance value of the attraction unit 1 by detecting a current flowing therein responsive to a voltage applied thereto. The resistance value of the attraction unit 1 is the resistance of an attraction roller (ATTR) 1*a* that attracts the printing medium to the conveyer belt, and a driving roller that controls the printing medium to be moved to the transferring device 2 by the conveyer belt.

When the resistance of the attraction unit 1 is known, a current flowing therein is detected in response to a test voltage while the printing medium in the attraction unit 1. In this manner, a resistance value that corresponds to that of the printing medium is obtained. With such a recognized resistance value, an optimal transfer voltage for a transferring operation can be determined.

However, the conventional image forming apparatus determines the resistance value of the transferring unit 2*a* closest to the attraction unit 1, and therefore when power is applied to the attraction unit 1 to determine the resistance value thereof, a leakage current from the attraction unit 1 may interact with the transferring unit 2*a* so that the resistance value of the transferring unit 2*a* may not be accurately obtained.

As illustrated in FIG. 2, the conventional image forming apparatus obtains a resistance value of the transferring unit 2*a* during a period of t1 to t2, and obtains the resistance value of the attraction unit 1 during a period of t2 to t3 after the resistance value of the transferring unit 2*a* has been determined.

In the period of t4 to t6, a resistance value of the printing medium is ascertained so that an appropriate attraction current to each printing medium may be applied, and the appropriate attraction current is applied to the printing medium during a period of t6 to t7.

At the same time, a transfer current is applied to the transferring unit 2*a* during the period of t6 to t7 so as to transfer a developer onto the printing medium. In this case, the attraction unit 1 and the transferring unit 2*a* are located close to each other such that the applied current in each gives rise to a current leakage into the other, thereby causing an undesirable interaction therebetween.

Accordingly, the attraction current is leaked to the transferring unit 2*a*, and thus an attraction voltage cannot be maintained at an appropriate attraction voltage level, and the transfer current is leaked through the attraction unit 1, and thus a transfer voltage cannot be maintained at an appropriate transfer voltage level so that both of the attraction voltage and the transfer voltage become less than the required level, thereby causing errors in the attraction and transferring operations.

The above information disclosed in this Background Section is provided to facilitate understanding of the present general inventive concept in the context of certain shortcomings in the image forming art. The description above is not intended as an admission that such context of the described shortcomings is prior art under Title 35 of the United States Code.

SUMMARY OF THE INVENTION

The present general inventive concept provides an image forming apparatus that utilizes a transferring unit that is not affected by a leakage current from an attraction unit, and the attraction unit that is not affected by a leakage current from the transferring unit during a transferring process. Thus, a transfer voltage/current and an attraction voltage/current can be maintained at a desired level to thereby determine an accurate transfer voltage or an accurate transfer current while increasing stability of an image, and a transferring method thereof.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing an image forming apparatus comprising a moving unit which moves a printing medium, a first roller which faces the moving unit, a second roller which is opposite to the first roller across the moving unit and disposed proximal to a photosensitive body, a power supply which supplies a first voltage and a second voltage to the first roller and the second roller, respectively, and a controller which controls the power supply to supply either of the first voltage or the second voltage when the printing medium enters between the first roller and the second roller.

The moving unit may comprise a conveyor belt to move the printing medium.

The first roller may attract the printing medium to the conveyor belt, and the second roller may transfer developer from the photosensitive body to the printing medium.

The controller may comprise a voltage/current detector which detects a voltage applied to or a current flowing in either the second roller or the first roller according to the power supplied thereto, and a transfer voltage/current determiner which determines a resistance value of the second roller from the detected current and determines a transfer voltage.

The voltage/current detector may respectively detect a voltage or a current in the case where the printing medium is attached to the conveyer belt by first roller and in the case where the printing medium is not attached to the conveyer belt, and the controller determines a resistance value of the printing medium by the detected voltage or the detected current and controls the power supply to provide the attraction power and the transfer power based on the determined resistance value of the printing medium.

The power supply may supply the transfer power when a front end of the printing medium reaches a proximity of a transfer nip of the second roller.

The image forming apparatus may include a plurality of transfer rollers aligned with the second roller to respectively transfer a plurality of colors to the printing medium.

The foregoing and/or other aspects and utilities of the present general inventive concept are also achieved by providing a transferring method of an image forming apparatus comprising a moving unit which includes a conveyer belt to move a printing medium, a first roller which attracts the printing medium to the conveyer belt, and a second roller which is located within a length of the printing medium from the first roller, and includes a photosensitive body and a transfer roller to transfer developer onto the printing medium, the transferring method comprising, detecting a first voltage applied to or a first current flowing in the first roller, determining a resistance value of the first roller according to the detected first voltage or current, determining power to attract the printing medium according to the detected first voltage or current, applying the determined attraction power to the printing medium, and blocking the attraction power when the printing medium passes the first roller.

The transferring method may further comprise detecting a second voltage applied to or a second current flowing in the second roller, determining a resistance value of the second roller according to the second detected voltage or current, determining power to transfer the developer onto the printing medium according to the recognized resistance value of the second roller, and applying the determined transfer power to the second roller.

The blocking of the attraction power may further comprise applying the transfer power after blocking the attraction power.

The blocking of the attraction power may comprise blocking the attraction power when a front end of the printing medium reaches a proximity of a transfer nip of the second roller.

The detecting of the first voltage or current may comprise respectively detecting a voltage or current in the case where the printing medium is attracted to the conveyer belt and in the case where the recording medium is not attracted to the conveyer belt, and the determining of the resistance value of the second roller may comprise determining a resistance value of the printing medium from the detected first voltage or current.

The foregoing and/or other aspects and utilities of the present general inventive concept are also achieved by providing an image forming apparatus comprising a moving unit which includes a conveyer belt to move a printing medium, a first roller which attracts the printing medium to the conveyer belt, a plurality of second rollers which respectively include a photosensitive body and a transfer roller to transfer developer on the printing medium corresponding to a plurality of colors, a power supply which supplies a transfer power to the second rollers to transfer the developer onto the printing medium and which supplies an attraction power to the first roller to attract the printing medium, and a controller which controls the power supply to supply the attraction power when a front end of the printing medium reaches the attraction unit, and which blocks the attraction power and supplies the transfer power when the front end of the printing medium reaches respective transfer nips of the second rollers.

The foregoing and/or other aspects and utilities of the present general inventive concept are also achieved by providing an image forming apparatus comprising a conveyor belt to transport a printing medium along a conveyance path, a power supply to generate a plurality of voltages at respective output terminals thereof, an attraction unit to receive an attraction voltage from one of the output terminals of the power supply and to provide the attraction voltage to the printing medium, a transferring unit to receive a transfer voltage from another output terminal of the power supply and to provide the transfer voltage to the conveyor belt, and a controller to provide a control signal to control the power supply to provide the attraction voltage and the transfer voltage in different time intervals.

The foregoing and/or other aspects and utilities of the present general inventive concept are also achieved by providing an image forming method comprising applying an attraction voltage to a printing medium until the printing medium advances along a conveyance path to a predetermined proximity of a transfer nip of a transferring unit, and removing the attraction voltage and applying a transfer voltage to the printing medium upon the printing medium being at the predetermined proximity, the attraction voltage and the transfer voltage being applied only in non-overlapping time intervals.

The foregoing and/or other aspects and utilities of the present general inventive concept are also achieved by providing a method to transfer a developed image to a printing medium comprising measuring a response signal to a test signal to determine a resistance value of a transferring unit, determining a transfer voltage to transfer the developed image in the transferring unit onto the printing medium based on the determined resistance, applying an attraction voltage to the printing medium in a first time interval, and applying the transfer voltage to the transferring unit to transfer the developed image to the printing medium in a second time interval.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
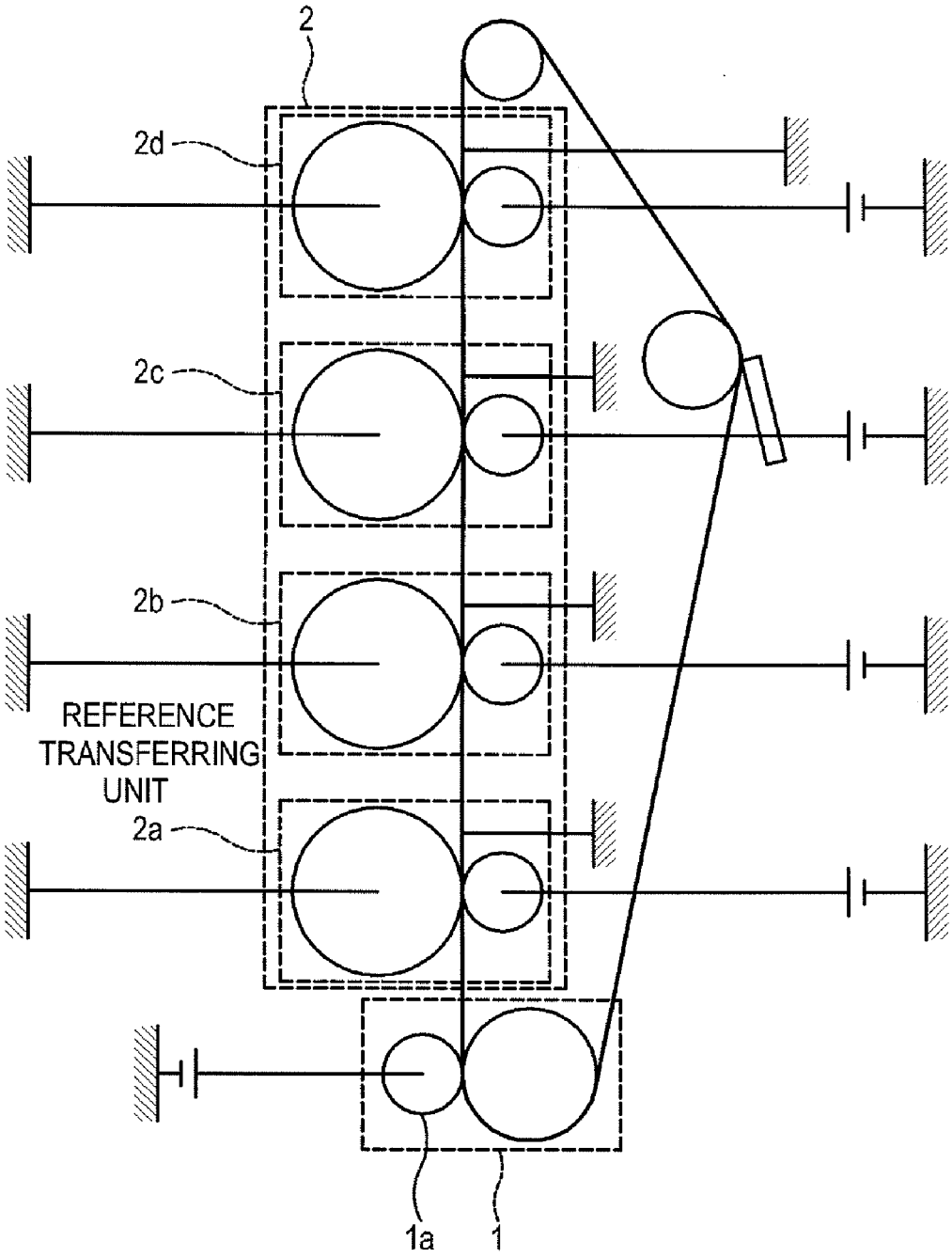
FIG. 1 (RELATED ART)
FIG. 1 is a schematic diagram illustrating a transferring process of a conventional image forming apparatus.
Figure 2:
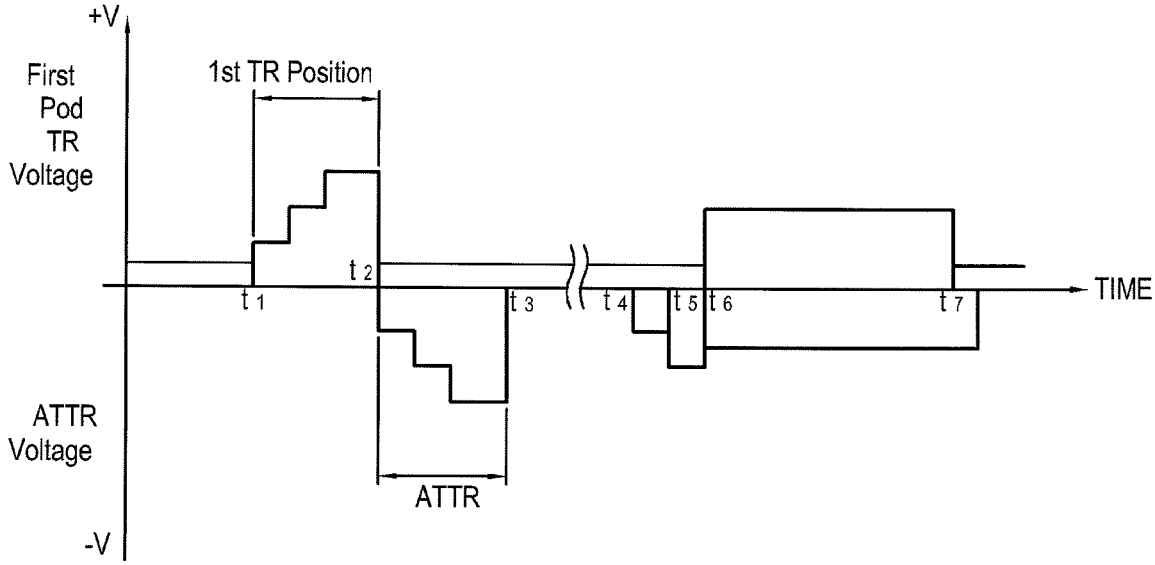
FIG. 2 (RELATED ART)
FIG. 2 is a diagram illustrating a system recognition process of the conventional image forming apparatus.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the figures.

Hereinafter, an image forming apparatus according to an exemplary embodiment of the present general inventive concept will be described with reference to the accompanying drawings.

Figure 3:
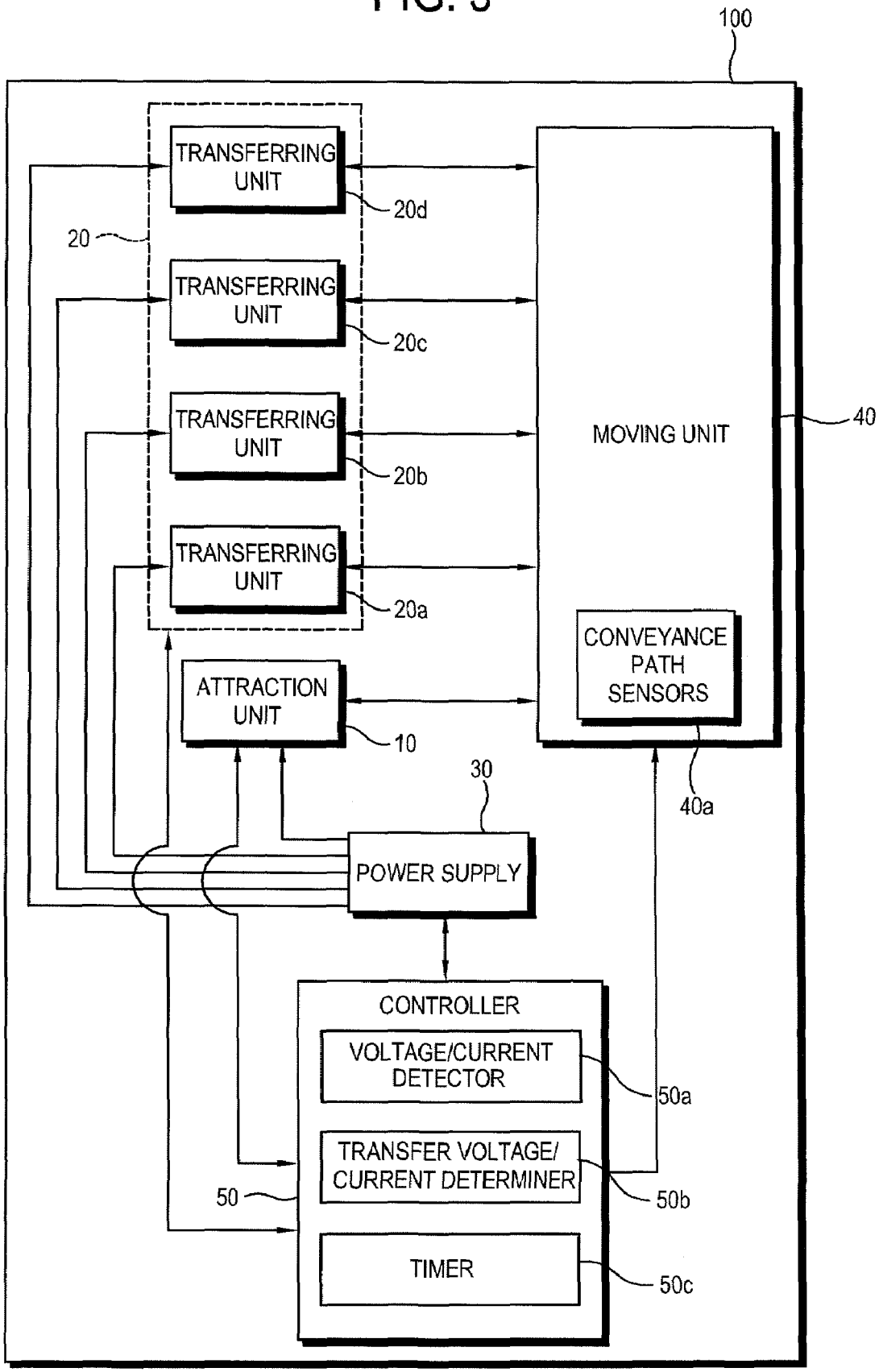
FIG. 3 is a block diagram of an image forming apparatus according to an exemplary embodiment of the present general inventive concept.
Figure 4:
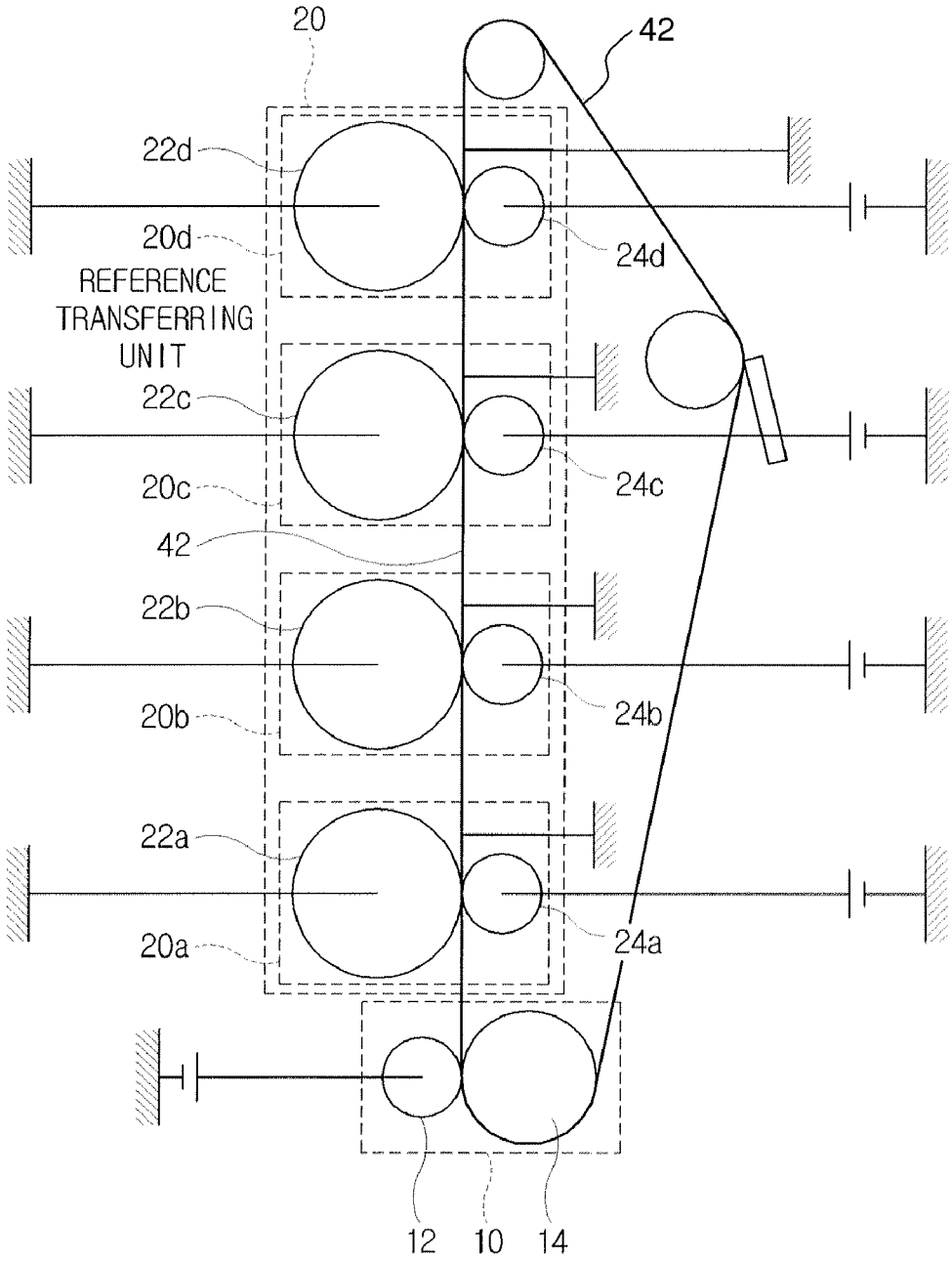
FIG. 4 is a schematic diagram illustrating a transferring process of the image forming apparatus according to the exemplary embodiment of the present general inventive concept.

FIG. 3 is a block diagram of an image forming apparatus 100 according to an exemplary embodiment of the present general inventive concept, and FIG. 4 illustrates a transferring process of the image forming apparatus 100 according to the exemplary embodiment of the present general inventive concept. It is to be understood that the schematic diagrams of FIGS. 3 and 4 depict only those exemplary components central to the description of the present general inventive concept, in the context of an exemplary image forming apparatus, and certain auxiliary elements of the embodied present general inventive concept that may underlie the full implementation thereof, but are trivial to the fundamental concepts thereof, will be omitted in the interest of brevity of the description and the intelligibility of the drawings.

As illustrated in FIG. 3, an image forming apparatus 100 according to an exemplary embodiment of the present general inventive concept includes an attraction unit 10, a transferring unit 20, a power supply 30, a moving unit 40, and a controller 50, and may be realized as a printing device having transferring units respectively corresponding to a plurality of colors (e.g., cyan, magenta, yellow, and black).

As illustrated in FIG. 4, the attraction unit 10 includes an attraction roller 12 and a driving roller 14, and attracts a printing medium onto a conveyer belt 42, such as by electrostatic attraction, to move the printing medium through the transferring unit 20.

The transferring unit 20 includes a photosensitive body, a representative one of which is illustrated at 22, and a transfer roller, a representative one of which is illustrated at 24, to transfer a plurality of colors to the printing medium, and is connected with the attraction unit 10 by the conveyer belt 42. A transfer roller 24 faces a photosensitive body 22 on an opposing side of the conveyer belt 24 and transfers toner developed on the photosensitive body 22 to the printing medium. In the exemplary embodiment as illustrated in FIGS. 3 and 4, the transferring unit 20 includes first to fourth transferring units 20*a* to 20*d*, which will alternatively be referred to as TR pods 20*a* to 20*d*.

The first transferring unit 20*a* is disposed most nearly to the attraction unit 10 among a plurality of transferring units 20, and the second to fourth transferring units 20*b* to 20*d* are aligned to the first transferring unit 20*a* in an order defined by a moving direction of the printing medium. The number of transferring units 20 may be established to correspond to cyan, magenta, yellow, and black (CMYK) according to an exemplary embodiment of the present general inventive concept.

The power supply 30 supplies attraction power and transfer power to the attraction unit 10 and the transferring unit 20 so as to form an electric field on the attraction roller 12 and the transfer rollers 24*a*-24*d* to attract the printing medium to the conveyor belt 42 and transfer the developed image onto the printing medium, respectively. The power supply 30 may have a plurality of output terminals electrically coupled to each transferring unit 20*a*-20*d*, and to the attraction unit 10.

The moving unit 40 includes the conveyer belt 42 and associated mechanisms to move the printing medium to the transferring unit 20 from the attraction unit 10. Additionally, the moving unit 40 may include a system of conveyance path sensors 40*a* that indicate at certain time intervals a position on the conveyance path at which the printing medium is located.

The controller 50 controls, among other components in the image forming device, the power supply 30 to supply power corresponding to a resistance value of, for example, the transfer roller 24*a* in the first transferring unit 20*a* to the transferring units 20*a*, 20*b*, 20*c*, and 20*d*. Thus, the controller 50 may be electrically coupled to the power supply 30 to provide a suitable control signal thereto that directs the power supply 30 to output a set of voltages, or, alternatively, currents, at its output terminals.

The controller 50, according to the exemplary embodiment, may include a voltage/current detector 50*a* and a transfer voltage/current determiner 50*b*. The voltage/current detector 50*a* detects the amplitude of a voltage or current flowing in the transferring unit 20 as a function of the power supplied from the power supply 30. The transfer voltage/transfer current determiner 50*b* calculates a resistance value of the reference transferring unit 20*a* based on the voltage and current detected by the voltage/current detector 50*a*, and determines a transfer voltage or a transfer current based on the calculated resistance.

The voltage/current detector 50*a* may be implemented in a circuit to detect the current flowing in the transferring unit 20 for a given voltage provided by the power supply 30. Alternatively, the voltage/current detector 50*a* may be implemented as a circuit that detects the voltage induced in the transferring unit 20 for a given current provided by the power supply 30. The voltage/current detector 50 may include suitable transforming circuitry to produce respective digital values of the voltage and current detected in the transferring unit 20. The transfer voltage/current determiner 50*b* may include a computational unit to determine the resistance value based on the voltage and current detected by the voltage/current detector 50 and, therewith, may determine a compensated amplitude of the transfer voltage/current.

The controller 50 illustrated in FIG. 3 may be implemented in a combination of hardware and software. For example, certain components, such as the transfer voltage/current determiner 50*b*, may be realized as processor instructions executing in one or more computer execution threads on one or more processors. The functional components of the controller 50 illustrated in FIG. 3 as well as others, may each be implemented on a dedicated processor, or may be executed on a single processor. Alternatively, each component illustrated in FIG. 3 may be realized in one or more application specific circuits. The present general inventive concept may be embodied through numerous configurations other than that illustrated in FIG. 3 without deviating from the spirit and intended scope thereof.

Figure 5A:
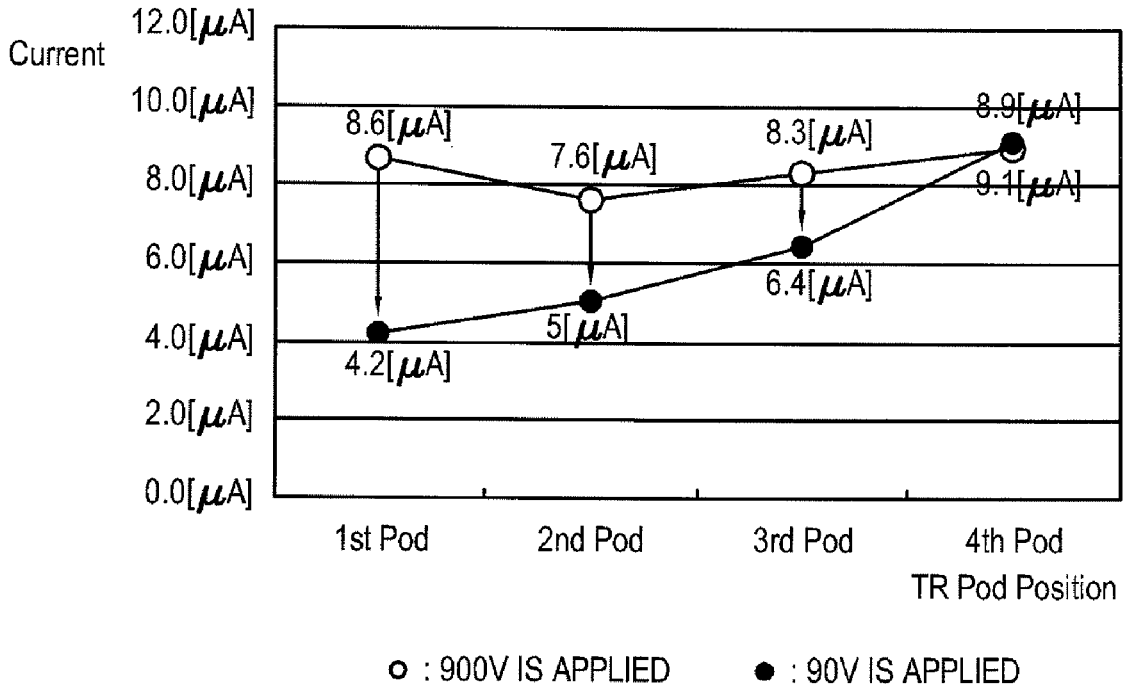
FIG. 5A and FIG. 5B are graphs illustrating interaction in the image forming apparatus according to the exemplary embodiment of the present general inventive concept.

FIG. 5A is a graph illustrating the magnitude of a current flowing in the respective transferring units 20 in the case where power is applied to the attraction unit 10 and the case where the power is not applied to the attraction unit 10. As illustrated in FIG. 5A, when the power is applied to the attraction unit 10, the first TR pod 20*a* positioned closest to the attraction unit 10 has a leakage current value of 4.4 μA(=8.6 μA-4.2 μA), which is the largest value, and the TR pod 20*d* disposed farthest from the attraction unit 10 has a leakage current value of 0.2 μA(=9.1 μA-8.9 μA), which is the smallest value.

Figure 5B:
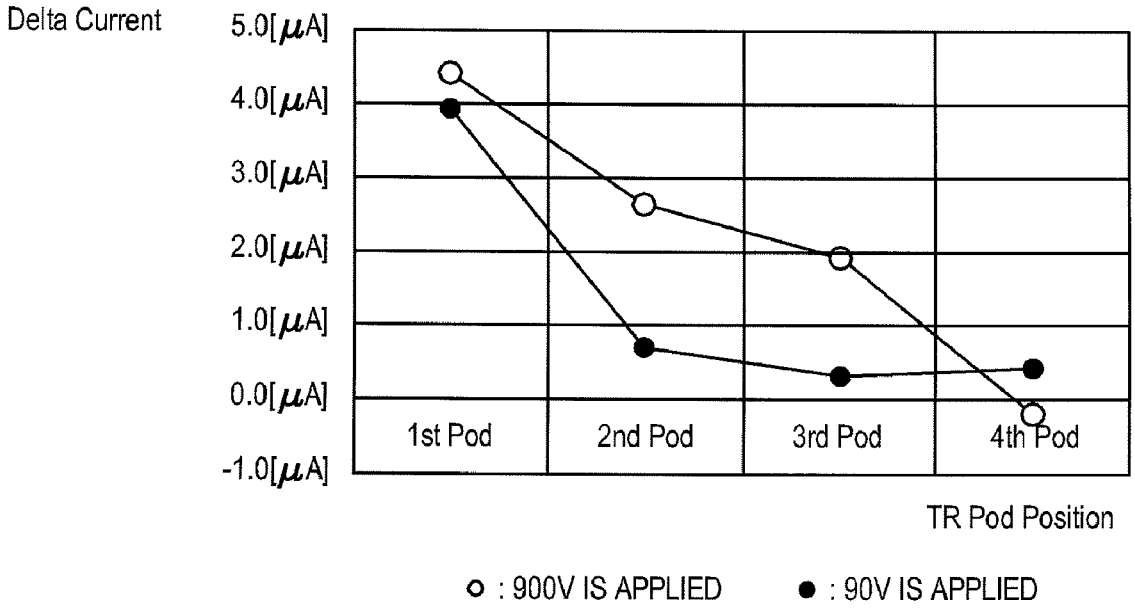

FIG. 5B illustrates the magnitude of the leakage current flowing in the respective transferring units 20 according to the amplitude of the voltage applied to the transferring units 20 in the case where power is applied to the attraction unit 10 and the transferring unit 20. As illustrated in FIG. 5B, the magnitude of the leakage current increases as the amplitude of the voltage applied to the transferring unit 20 increases, and the transferring unit 20*a* positioned closest to the attraction unit 10 has the leakage current values of 3.9 μA and 4.4 μA due to the application of 90V and 900V, respectively, to the attraction unit 10. The transferring unit 20*d* disposed farthest from the attraction unit 10 has the leakage current values of 0.4 μA and −0.2 μA due to the application of 90V and 900V, respectively.

That is, the transferring unit 20*a* disposed closest to the attraction unit 10 has the largest leakage current value and the transferring unit 20*d* disposed farthest from the attraction unit 10 has the smallest leakage current value. Therefore, when the transfer current is applied, the amount of the leakage current can be reduced by turning off the attraction unit 10 at an appropriate time so as to prevent the transfer current from being leaked to the attraction unit 10.

Figure 6A:
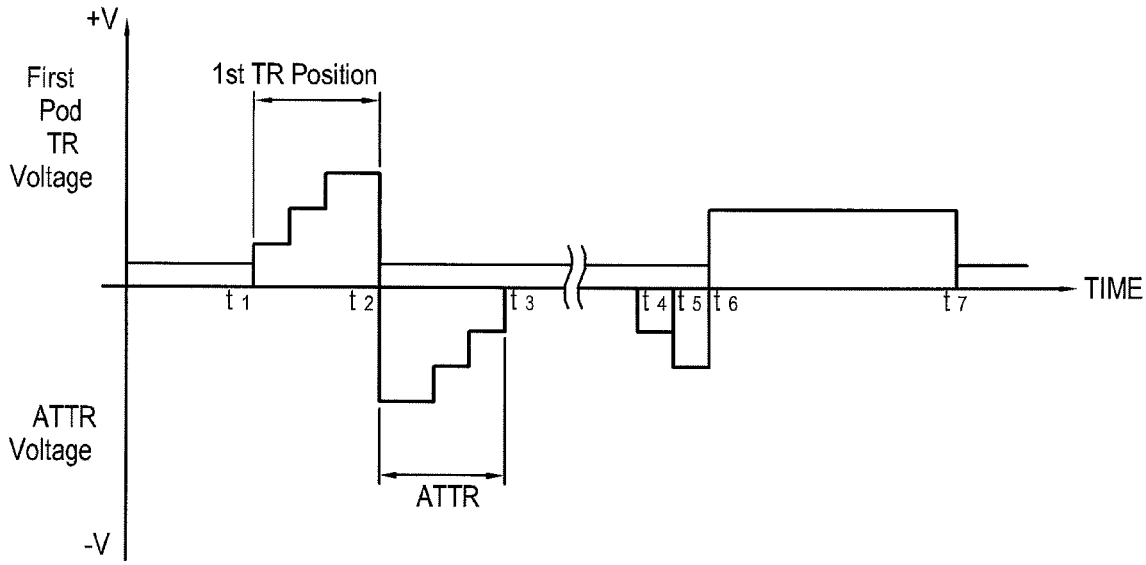
FIG. 6A and FIG. 6B are diagrams illustrating a power applying method of a controller according to a sequential order of time according to the exemplary embodiment of the present general inventive concept.
Figure 6B:
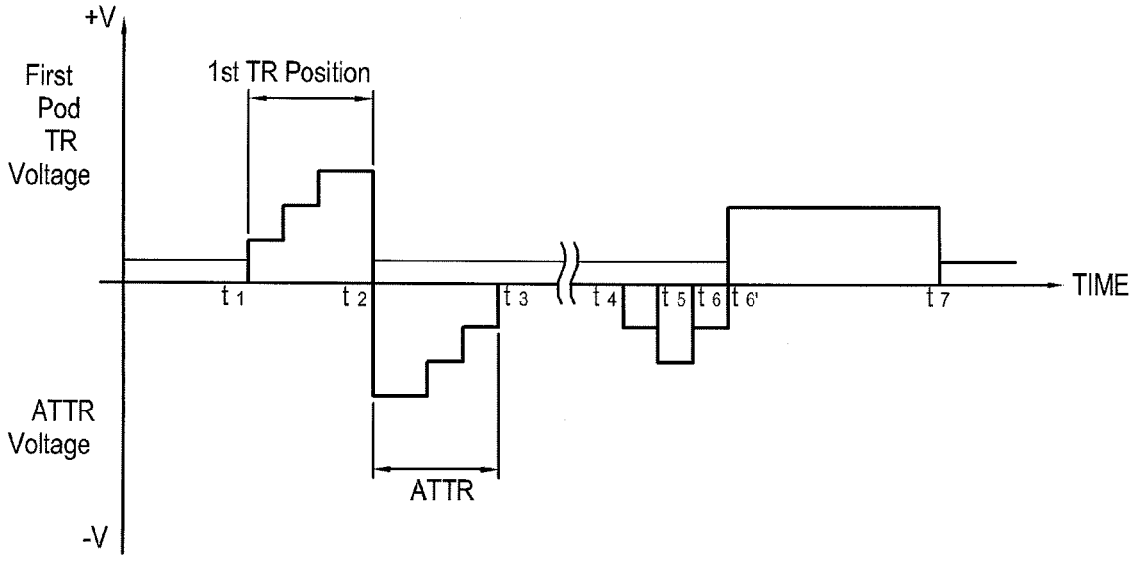

FIG. 6A and FIG. 6B illustrate exemplary application timing of transfer power and attraction power in accordance with certain embodiments of the present general inventive concept. As is illustrated in FIGS. 6A and 6B, if the transfer current is applied after time t6 while blocking the attraction current, the transfer current is not leaked through the attraction unit 10 and the transfer current can be maintained at the level determined by the controller for the resistance values previously obtained.

In the exemplary timing illustrated in FIG. 6A, the printing medium is within the attraction unit 10 at time t4. A front end of the printing medium reaches the first transferring unit 20*a* at time t6, at which time the attraction current is blocked and the transfer current is applied. At time t6, the front end of the printing medium may be proximal to the transfer nip of the first transferring unit 20*a* at which time, in certain embodiments of the present general inventive concept, an attraction current is then blocked. That is, the attraction current is blocked and only the transfer current is applied when the printing medium is sufficiently proximal to the nip of the transferring unit 20*a* that release of the attraction voltage will not impact the registration of the printing medium therein.

In addition, as illustrated in FIG. 6B, the attraction current may be applied at time t6 so that the printing medium can advance to the proximity of the transfer nip, as described above, and subsequent thereto, the transfer current is applied while blocking the attraction current at time t6'. Thus, transfer current is not leaked through the attraction unit 10 so that the transfer current can be maintained at the level computed by the controller 50.

In FIG. 6B, the printing medium may be within the attraction unit 10 at the time t4, whereupon the resistance value thereof may be determined. The front end of the recording medium may reach the first transferring unit 20*a* at the time t6', at which time the attraction current is blocked and the transfer current is applied. That is, the attraction current is blocked and the transfer current is applied when the printing medium is sufficiently proximal to the nip of the transferring unit 20*a*.

In the embodiment of FIG. 6A, the distance between the attraction unit 10 and the first transferring unit 20*a* is sufficiently short, such as within the length of the printing medium, so that the application of the attraction current to the printing medium can be avoided. In other embodiments of the present general inventive concept, such as that illustrated in FIG. 6B, the distance between the attraction unit 10 and the first transferring unit 20*a* is sufficiently long, such as greater than the length of the printing medium, so that the attraction unit 10 applies the attraction current to the printing medium until the front end of the printing medium is proximal to the nip of the first transferring unit 20*a*, at which time, the attraction current is blocked and only the transfer current is applied. In certain embodiments of the present general inventive concept, the application of the attraction current is a function of the dimensions of the printing medium, which may be determined by the conveyance path sensors 40*a*, or by a printing medium selection command.

It is to be understood that although the application of voltages illustrated in FIGS. 6A and 6B is illustrated in units of time, the actual timing of the application of voltages may be in accordance with a position of the printing medium in the conveyance path. Thus, the application timing may be realized through a timer, such as timer 50*c* in controller 50, conveyance path sensors 40*a* suitably located on the conveyance path, or a combination of both. For example, a conveyance path sensor may trigger the timer 50*c*, which can be set to fine tune the application intervals of the attraction power and the transfer power.

Figure 7:
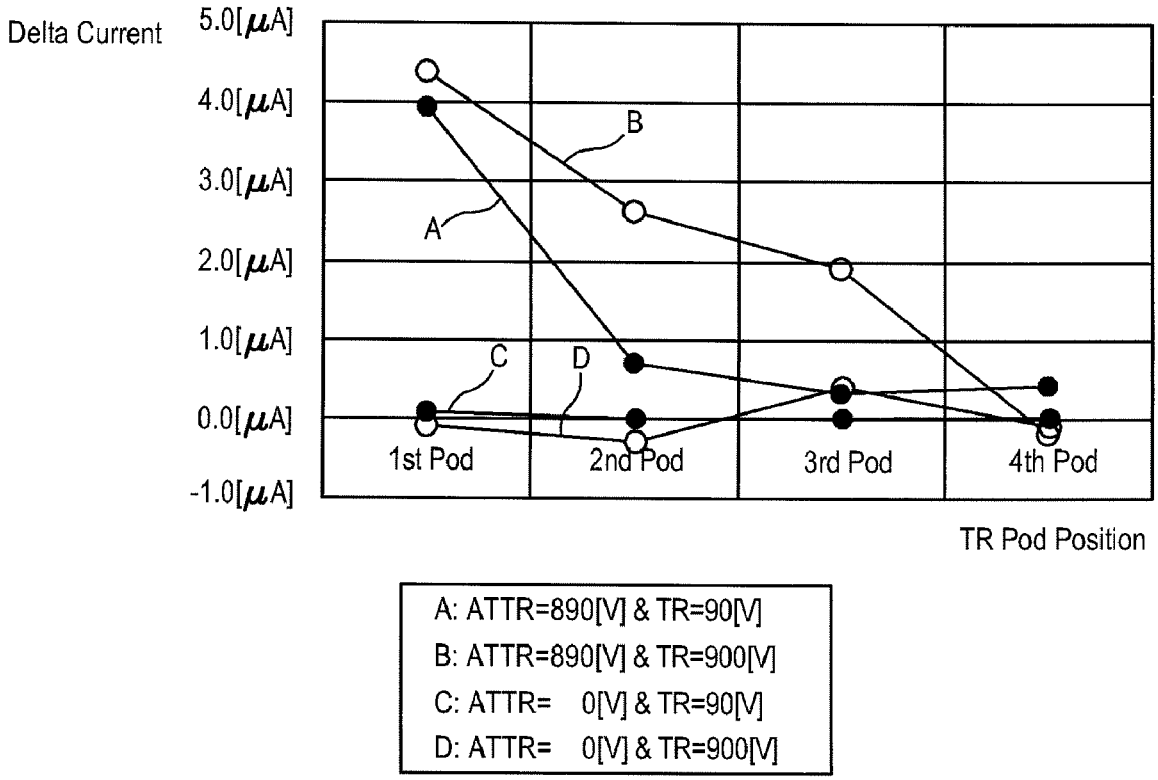
FIG. 7 is a graph illustrating an effect of interaction of a transferring unit according to the exemplary embodiment of the present general inventive concept.

FIG. 7 illustrates results of separating application timing of the attraction current and the transfer current as in the exemplary embodiments of the present general inventive concept of FIG. 6A and FIG. 6B. The results of FIG. 5B are overlaid by the new results in FIG. 7 for comparison. As is illustrated, when a transfer voltage of either 900V or 90V is applied, a current difference in the first transferring unit 20*a* remains within 0.5 μA when the attraction voltage is set to 0V by blocking current flowing to the attraction unit 10. That is, there is an acceptable current in the two cases. Thus, the transfer voltage can be maintained at a proper level to properly execute the transferring operation.

Although the transfer voltage is maintained at a proper level while applying a current to the transferring unit according to the present exemplary embodiment, a transfer current can be maintained at a proper level while applying a voltage to the transferring unit according to another exemplary embodiment of the present general inventive concept.

An operation of the image forming apparatus according to the exemplary embodiment of the present general inventive concept will be described in further detail. When the front end of the printing medium reaches the attraction unit 10, the attraction power is applied to the printing medium until the front end of the printing medium is proximal to the nip the first transferring unit 20*a* that is located close to the attraction unit 10 among the plurality of transferring units.

When the front end of the printing medium reaches the transfer nip of the transferring unit 20*a*, the attraction power is blocked and, at the same time, the transfer power is applied to the printing medium. Although the attraction power is not additionally applied to the printing medium when the printing medium enters the transferring unit 20, the printing medium can be attracted on the conveyer belt by power applied from the transferring unit 20 so that the printing medium can be moved by the transfer nip formed by photosensitive bodies 22*a*, 22*b*, 22*c*, and 22*d* and transfer rollers 24*a*, 24*b*, 24*c*, and 24*d* of the transferring unit 20.

In addition, as indicated above, the location of the printing medium can be detected by a photo-sensor in the conveyance path sensor system 40*c* that can detect a front end or a rear end of the printing medium. For example, when the front end of the printing medium enters the sensing area of a particular sensor, the level of the photo sensor may be switched from the on state to the off state or from the off state to on state so that the location of the printing medium can be determined. When the location of the printing medium is determined, application timing of the attraction power or the transfer power can be established accordingly.

Figure 8:
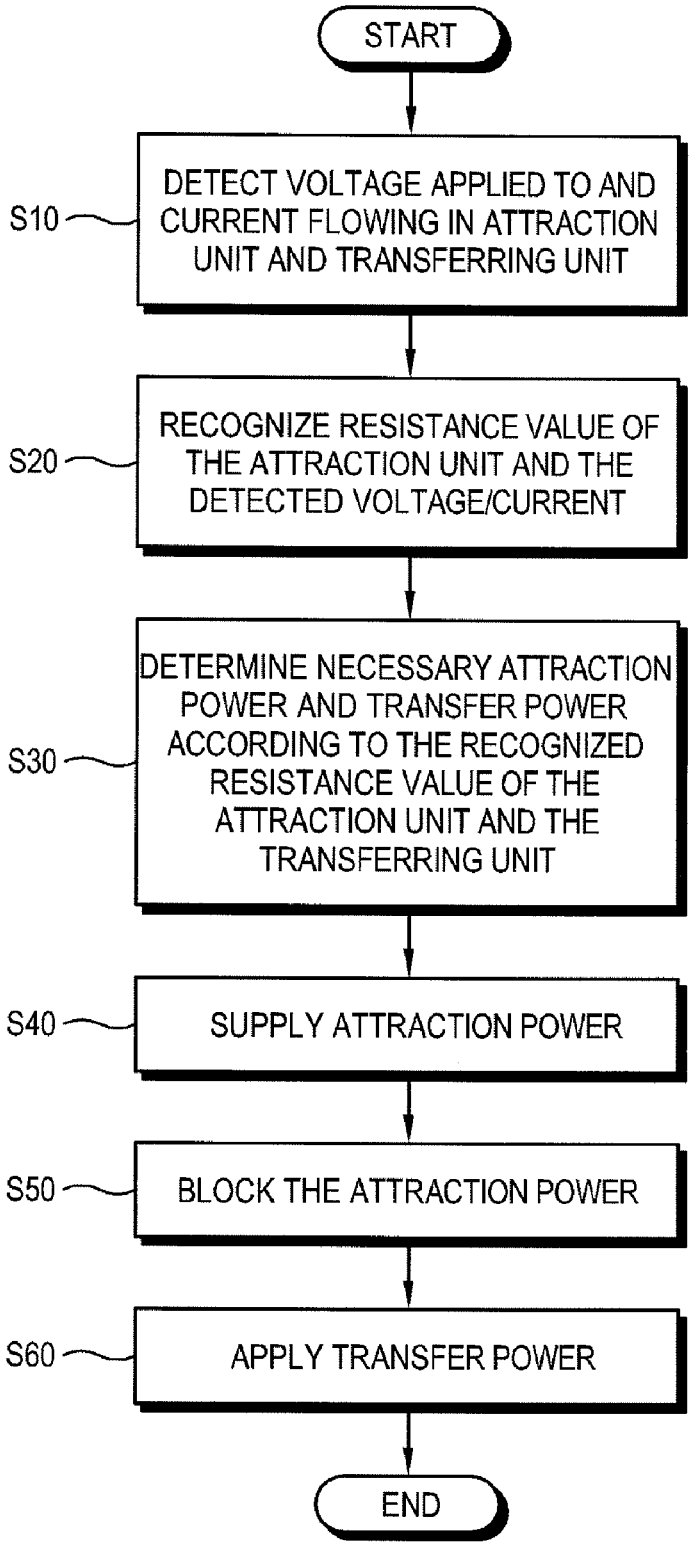
FIG. 8 is a flowchart illustrating an exemplary transferring method of the image forming apparatus according to the exemplary embodiment of the present general inventive concept.

A transferring method of the image forming apparatus 100 according to the exemplary embodiment of the present general inventive concept will be described in further detail with reference to FIG. 8.

At operation S10, the controller 50 detects a voltage applied to or a current flowing in the attraction unit 10 and the transferring unit 20. Here, the controller 50 may detect a voltage applied to or a current flowing in any one of the first to fourth transferring units 20*a*, 20*b*, 20*c*, and 20*d*. The controller 50 may have access to the location of the first transferring unit 20*a* next to the attraction unit 10 in a moving direction of the printing medium.

At operation S20, the controller 50 calculates a resistance value of the attraction unit 10 and a resistance value of the first transferring unit 20*a* according to the voltage and current obtained in operation S10. At operation S30, the controller 50 determines power to transfer a developer onto the printing medium according to the resistance value of the first transferring unit 20*a* determined in operation of S20, and determines power to attract the printing medium according to the resistance value of the attraction unit 10.

When the front end of the printing medium reaches the attraction unit 10, at operation S40, the controller 50 controls the power supply 30 to supply the power determined at operation S30 to the attraction unit 10.

At operation S50, the controller 50 controls the power supply 30 to block the power applied to the attraction unit 10 when the front end of the printing medium reaches the transferring unit 20, particularly, the proximity of the transfer nip of the first transferring unit 20*a*.

As the power to the attraction unit 10 is blocked in operation S50, the power supply 30 supplies the transfer power determined at the operation S30 to the first transferring unit 20*a*, and to the second to fourth transferring units 20*b*, 20*c*, and 20*d*, at operation of S60. The controller 50 may control the power supply 30 to block the attraction power (S50) and apply the transfer power (S60) at the same time.

The image forming apparatus according to the above-described exemplary embodiments of the present general inventive concept may include a plurality of transferring units 20, or the image forming apparatus may include a single transferring unit, and both apparatuses may utilize a conveyer belt and the power application system to embody the present general inventive concept.

As described above, an image forming apparatus and a transferring method of the image forming apparatus of precisely determining power to transfer a developed image onto a printing medium regardless of interaction between an attraction unit and a transferring unit, and maintaining the transfer power at a constant level, can be provided according to the exemplary embodiments of the present general inventive concept.

In addition, a load of a circuit unit or a controller can be reduced by applying power to only one of an attraction unit and a transferring unit, thereby maintaining system performance.

In addition, a conventional resistance recognition system that detects a voltage applied to or current flowing in the transferring unit and the attraction unit and recognizes a resistance value based on the detected voltage/current can be used according to the exemplary embodiment of the present general inventive concept, thereby achieving stable driving of a controller.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus comprising:

a moving unit which moves a printing medium;

a first roller which faces the moving unit;

a second roller which is opposite to the first roller across the moving unit and disposed proximal to a photosensitive body;

a power supply which supplies first and second voltages to the first roller and the second roller, respectively; and a controller which controls the power supply to supply either of the first voltage or the second voltage when the printing medium enters between the first roller and the second roller, wherein the controller comprises:

a detector to detect at least one of a voltage and a current, which detects a voltage applied to or a current flowing in either the second roller or the first roller according to the respective power supplied thereto; and a transfer determiner to determine at least one of a voltage and a current, which determines a resistance value of the second roller from the detected current and determines a transfer voltage.

2. The image forming apparatus of claim 1, wherein the moving unit comprises a conveyor belt to move the printing medium.

3. The image forming apparatus of claim 2, wherein the first roller attracts the printing medium to the conveyor belt, and the second roller transfers developer from the photosensitive body to the printing medium.

4. The image forming apparatus of claim 3 further including a plurality of transfer rollers aligned with the second roller to respectively transfer a plurality of colors to the printing medium.

5. The image forming apparatus of claim 2, wherein the detector to detect at least one of a voltage and a current respectively detects a voltage or a current in the case where the printing medium is attached to the conveyer belt by the first roller and in the case that the printing medium is not attached to the conveyer belt, and the controller determines a resistance value of the printing medium from the detected voltage or the detected current and controls the power supply to provide the attraction power and the transfer power based on the determined resistance value of the printing medium.

6. The image forming apparatus of claim 1, wherein the power supply supplies the transfer power when a front end of the printing medium reaches a proximity of a transfer nip of the second roller.

7. The image forming apparatus of claim 1 further including a plurality of transfer rollers aligned with the second roller to respectively transfer a plurality of colors to the printing medium.

8. A transferring method of an image forming apparatus comprising: a moving unit which includes a conveyer belt to move a printing medium; a first roller to attract the printing medium to the conveyer belt; and a second roller which is located within a length of the printing medium from the attraction unit, and includes a photosensitive body and a transfer roller to transfer developer on the printing medium, the transferring method comprising:

detecting a first voltage applied to or a first current flowing in the attraction unit;

detecting a second voltage applied to or a second current flowing in the second roller;

determining a resistance value of the first roller according to the detected first voltage or current;

determining a resistance value of the second roller according to the second detected voltage or current;

determining power to attract the printing medium to the conveyor belt according to the detected first voltage or current;

determining power to transfer the developer on the printing medium according to the determined resistance value of the second roller;

applying the determined attraction power to the printing medium;

blocking the attraction power when the printing medium passes the first roller, and applying the determined transfer power to the second roller, wherein the detecting the first voltage applied to or the first current flowing in the attraction unit and the detecting the second voltage applied to or the second current flowing in the second roller comprise detecting a voltage applied to or a current flowing in either the second roller or the first roller according to respective power supplied thereto, and the determining of the resistance value of the second roller comprises determining a resistance value of the second roller from the detected current and determining a transfer voltage.

9. The transferring method of claim 8, wherein the blocking of the attraction power further comprises applying the transfer power after blocking the attraction power.

10. The transferring method of claim 8, wherein the blocking of the attraction power further comprises applying the transfer power after blocking the attraction power.

11. The transferring method of claim 8, wherein the blocking of the attraction power comprises blocking the attraction power when a front end of the printing medium reaches a proximity of a transfer nip of the second roller.

12. The transferring method of claim 11, wherein the detecting of the first voltage or current comprises respectively detecting a voltage or current in the case where the printing medium is attracted to the conveyer belt and in the case where the recording medium is not attracted to the conveyer belt, and the determining of the resistance value of the second roller comprises determining a resistance value of the printing medium from the detected first voltage or current.

13. The transferring method of claim 8, wherein the detecting of the first voltage or current comprises respectively detecting a voltage or current in the case where the printing medium is attracted to the conveyer belt and in the case where the recording medium is not attracted to the conveyer belt, and the determining of the resistance value of the second roller comprises determining a resistance value of the printing medium from the detected first voltage or current.

14. An image forming apparatus comprising:

a moving unit which includes a conveyer belt to move a printing medium;

a first roller to attract the printing medium to the conveyer belt;

a plurality of second rollers which respectively include a photosensitive body and a transfer roller to transfer developer on the printing medium corresponding to a plurality of colors;

a power supply which supplies a transfer power and an attraction power to the second rollers and the first roller to transfer the developer and to attract the printing medium to the conveyor belt; and a controller which controls the power supply to supply the attraction power when a front end of the printing medium reaches the attraction unit, and which blocks the attraction power and supplies the transfer power when the front end of the printing medium reaches respective transfer nips of the second rollers, wherein the controller comprises:

a detector to detect at least one of a voltage and a current which detects a voltage applied to or a current flowing in either the second roller or the first roller according to the respective power supplied thereto; and a transfer determiner to determine at least one of a voltage and a current which determines a resistance value of the second roller from the detected current and determines a transfer voltage.

15. An image forming apparatus comprising:

a conveyor belt to transport a printing medium along a conveyance path;

a power supply to generate a plurality of voltages at respective output terminals thereof;

an attraction unit to receive an attraction voltage from one of the output terminals of the power supply and to provide the attraction voltage to the printing medium;

a transferring unit to receive a transfer voltage from another one of the output terminals of the power supply and to provide the transfer voltage to the conveyor belt; and a controller to provide a control signal to control the power supply to provide the attraction voltage and the transfer voltage in different, non-overlapping time intervals, wherein the controller includes a current detector to measure a current in the transferring unit generated in response to a test voltage applied thereto.

16. The image forming apparatus of claim 15, wherein the controller includes a voltage determiner to determine the transfer voltage that compensates a resistance of the transferring unit calculated from the current and the test voltage.

17. The image forming apparatus of claim 15, wherein the control signal controls the power supply to block the attraction voltage simultaneously with the application of the transfer voltage.

18. The image forming apparatus of claim 15, further comprising:

at least one conveyance path sensor to provide a signal to the controller indicative of a location of the printing medium on the conveyance path, the controller to generate the control signal in response to the signal from the conveyance path sensor.

19. The image forming apparatus of claim 18, wherein the signal from the conveyance path sensor indicates that the printing medium is proximal to the transfer nip of the transferring unit.

20. The image forming apparatus of claim 18, wherein the controller includes a timer to generate the control signal in response to the signal from the conveyance path sensor and in response to a time provided by the timer.

21. An image forming method comprising:

detecting a voltage applied to or a current flowing in either a first roller or a second roller according to respective power supplied thereto;

determining a resistance value of the second roller from the detected current and determining a transfer voltage;

applying an attraction voltage to a printing medium until the printing medium advances along a conveyance path to a predetermined proximity of a transfer nip of a transferring unit; and removing the attraction voltage and applying the determined transfer voltage to the printing medium upon the printing medium being at the predetermined proximity, the attraction voltage and the transfer voltage being applied only in non-overlapping time intervals, wherein the first roller faces the moving unit and the second roller is opposite to the first roller across a moving unit and disposed proximal to a photosensitive body.

22. A method to transfer a developed image to a printing medium comprising:

measuring a response signal to a test signal to determine a resistance value of a transferring unit;

determining a transfer voltage to transfer the developed image in the transferring unit onto the printing medium based on the determined resistance;

applying an attraction voltage to the printing medium in a first time interval; and applying the transfer voltage to the transferring unit to transfer the developed image to the printing medium in a second time interval, wherein, the second time interval temporally non-overlaps the first time interval, wherein the measuring the response signal to the test signal comprises detecting a voltage applied to or a current flowing in either a first roller or a second roller according to respective power supplied thereto, and the determining the transfer voltage comprises determining a resistance value of the second roller from the detected current, wherein the first roller faces the moving unit and the second roller is opposite to the first roller across a moving unit and disposed proximal to a photosensitive body.

23. The method to transfer a developed image of claim 22, further comprising:

applying a second test signal to the attraction unit and measuring a second response signal to determine a resistance value thereof prior to the first time interval; and applying the attraction voltage to the printing medium based on the resistance value of the attraction unit.

24. The method to transfer a developed image of claim 23, further comprising:

applying a third test signal to the attraction unit while the printing medium is located therein and measuring a third response signal prior to the second time interval;

determining a resistance value of the printing medium from the third test signal, the third response signal, and the resistance of the attraction unit; and applying the transfer voltage in the second time interval based on the resistance value of the printing medium.

25. The method to transfer a developed image of claim 22, wherein the test signal is a voltage and the response signal is a current.

26. The method to transfer a developed image of claim 22, wherein the test signal is a current and the response signal is a voltage.

* * * * *